US010424246B2

(12) United States Patent
Yuan

(10) Patent No.: US 10,424,246 B2
(45) Date of Patent: Sep. 24, 2019

(54) PIXEL CIRCUIT AND METHOD FOR DRIVING PIXEL CIRCUIT

(71) Applicant: SHENZHEN ROYOLE TECHNOLOGIES CO., LTD., Shenzhen (CN)

(72) Inventor: Ze Yuan, Shenzhen (CN)

(73) Assignee: SHENZHEN ROYOLE TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 15/738,714

(22) PCT Filed: Jul. 21, 2015

(86) PCT No.: PCT/CN2015/084713
§ 371 (c)(1),
(2) Date: Dec. 21, 2017

(87) PCT Pub. No.: WO2017/012075
PCT Pub. Date: Jan. 26, 2017

(65) Prior Publication Data

US 2018/0174512 A1 Jun. 21, 2018
US 2019/0027091 A9 Jan. 24, 2019

(51) Int. Cl.

| | |
|---|---|
| ***G09G 3/30*** | (2006.01) |
| ***G09G 3/3233*** | (2016.01) |
| ***G09G 3/32*** | (2016.01) |
| ***G09G 3/3258*** | (2016.01) |

(52) U.S. Cl.
CPC ..... *G09G 3/3233* (2013.01); *G09G 3/32* (2013.01); *G09G 3/3258* (2013.01); *G09G 2300/08* (2013.01); *G09G 2300/0819* (2013.01); *G09G 2320/0233* (2013.01); *G09G 2320/045* (2013.01)

(58) Field of Classification Search
CPC ... G09G 3/3208; G09G 3/3233; G09G 3/3258
See application file for complete search history.

(56) References Cited

U.S. PATENT DOCUMENTS

| | | | | |
|---|---|---|---|---|
| 2014/0184665 | A1 | 7/2014 | Yoon et al. | |
| 2015/0187270 | A1* | 7/2015 | Lee | G09G 3/3233 345/76 |
| 2016/0104423 | A1* | 4/2016 | Park | G09G 3/3233 345/78 |

(Continued)

FOREIGN PATENT DOCUMENTS

| | | | |
|---|---|---|---|
| CN | 102222468 | A | 10/2011 |
| CN | 103915061 | A | 7/2014 |

(Continued)

OTHER PUBLICATIONS

Office Action issued in corresponding Chinese Application No. 201580001767.9 dated Oct. 10, 2018 (5 pages).

(Continued)

*Primary Examiner* — Roy P Rabindranath
(74) *Attorney, Agent, or Firm* — Na Xu; IPro, PLLC

(57) ABSTRACT

Disclosed are a pixel circuit and a method for driving the pixel circuit. The pixel circuit includes a driving transistor, a first transistor, a second transistor, a third transistor, a driving capacitor and a light-emitting element.

15 Claims, 9 Drawing Sheets

(56) References Cited

U.S. PATENT DOCUMENTS

2017/0011684 A1* 1/2017 Nakatani ..... G09G 3/2092

FOREIGN PATENT DOCUMENTS

JP 2007310311 A 11/2007
KR 2014-0086467 A 7/2014

OTHER PUBLICATIONS

Office Action issued in corresponding Korean Application No. 10-2017-7036078 dated Nov. 21, 2018, and English translation thereof (24 pages).
Office Action issued in corresponding JP Application No. 2018-500929 with English translation dated Feb. 5, 2019 (9 pages).
Office Action issued in corresponding EP Application No. 15898631.5 dated Feb. 5, 2019 (10 pages).

* cited by examiner

PIXEL CIRCUIT AND METHOD FOR DRIVING PIXEL CIRCUIT

FIELD

The present disclosure relates to a field of an organic light emitting display panel, and more particularly, to a pixel circuit capable of compensating a threshold voltage of an organic light emitting display panel and a method for driving the pixel circuit.

BACKGROUND

As a current mode light-emitting device, an organic light-emitting diode (OLED for short) has been increasingly applied in high-performance organic light-emitting display panels. Referring to FIG. 1, the OLED display panel pixel circuit in the related art includes a driving transistor MD, a transistor M1 functioning as a switch, a capacitor $C_{ST}$ and an organic light-emitting device, i.e., 2T1C. The organic light-emitting device includes an organic light-emitting diode $D_{OLED}$ and an inductance capacitor $C_{OLED}$ of the organic light-emitting diode $D_{OLED}$. The transistor M1 is connected to a data signal $V_{DATA}$ and is controlled by a scanning signal $V_{SCAN}$. The driving transistor MD is connected to a pixel power supply $V_{DD}$ and is also connected to the data signal $V_{DATA}$ via the transistor M1. Two terminals of the capacitor $C_{ST}$ are connected respectively to the pixel power supply $V_{DD}$ and a node A between the transistor M1 and the driving transistor MD. The organic light-emitting diode $D_{OLED}$ and the inductance capacitor $C_{OLED}$ are connected in parallel between the transistor MD and an external power supply $V_{SS}$. The voltage of the external power supply $V_{SS}$ is lower than the voltage of the pixel power supply $V_{DD}$, for example, the voltage of the external power supply $V_{SS}$ can be the ground voltage. When a gate of the transistor M1 responds to scanning signal $V_{SCAN}$ and conducts the transistor ML the capacitor $C_{ST}$ is charged based on the data signal $V_{DATA}$, and then the voltage in the capacitor $C_{ST}$ is applied on the gate of the driving transistor MD, thereby conducting the driving transistor MD, so that the organic light-emitting device through which current flows emits light.

The current provided to the organic light-emitting device via the driving transistor MD can be calculated by following formula:

$$I_{OLED}=\tfrac{1}{2}*\beta(V_{GS}-V_{TH})^2 \qquad \text{formula 1}$$

$I_{OLED}$ is the current flowing through the organic light-emitting device. $V_{GS}$ is a voltage applied between the gate and the source of the driving transistor MD, and $V_{GS}$ is determined by a voltage across the $C_{ST}$. $V_{TH}$ is a threshold voltage of the driving transistor MD. β is a gain factor of the driving transistor MD, which is determined by a size of the device and a carrier mobility of a semi-conductor. It can be seen from formula, the current flowing through the organic light-emitting device may be affected by the threshold voltage of the driving transistor MD. Since the threshold voltage of each transistor in the organic light-emitting display panel may be different from each other in a production process, as well as an electron mobility of each transistor. On this basis, the current $I_{OLED}$ generated in the circuit is variable even given the same $V_{GS}$, thereby resulting non-uniformity of brightness.

SUMMARY

Accordingly, the present disclosure aims to provide a pixel circuit that can eliminate the influence of a current variation caused by non-uniformity or drift of a threshold voltage on display effect and a method for driving the pixel circuit, and a display panel.

Embodiments of the present disclosure provide a pixel circuit, including: a driving transistor; a first transistor, a control electrode of the first transistor being connected to a first scanning line, and two controlled electrodes of the first transistor being connected to a data line and a control electrode of the driving transistor respectively; a second transistor, a control electrode of the second transistor being connected to a control line, and two controlled electrodes of the second transistor being connected to a first power line and a first controlled electrode of the driving transistor respectively; a third transistor, a control electrode of the third transistor being connected to a second scanning line, and two controlled electrodes of the third transistor being connected to a second power line and a second controlled electrode of the driving transistor respectively; a driving capacitor, two terminals of the driving capacitor being connected to the control electrode and the second controlled electrode of the driving transistor respectively; and a light-emitting element, comprising a light-emitting diode and an inductance capacitor of the light-emitting diode connected in parallel between a third power line and the second controlled electrode of the driving transistor.

Embodiments of the present disclosure provide a method for driving a pixel circuit, applied in the pixel circuit as described above, the driving transistor has a threshold voltage, including: conducting the first transistor, the second transistor and the third transistor, and charges stored in the driving capacitor being released to the data line and the second power line via the first transistor and the third transistor, respectively; conducting the first transistor and the second transistor, cutting off the third transistor, outputting by the data line a reference voltage to the driving transistor via the first transistor, a first voltage provided by the first power line being applied for charging the driving capacitor via the second transistor and the driving transistor until a voltage across a control electrode and a controlled electrode of the driving transistor being the threshold voltage; conducting the first transistor, cutting off the second transistor and the third transistor, outputting by the data line a data voltage higher than the reference voltage, and a voltage across the driving capacitor being charged to a sum of the threshold voltage and another voltage, the another voltage being related to a voltage difference between the data voltage and the reference voltage; and cutting off the first transistor and the third transistor, conducting the second transistor, driving by the driving capacitor the driving transistor to be conducted, such that the first voltage drives the light-emitting element to emit light.

Embodiments of the present disclosure provide a method for driving a pixel circuit, applied in the pixel circuit as described above, the driving transistor has a threshold voltage, including: conducting the first transistor, the second transistor and the third transistor, such that the driving transistor is conducted and a voltage across the driving capacitor and a voltage across the light-emitting element is reset; conducting the first transistor and the second transistor, cutting off the third transistor, enabling the data line to output a reference voltage, such that a voltage of a first node connecting the driving capacitor, the driving transistor and the light emitting element with each other is a voltage difference between the reference voltage and the threshold voltage; conducting the first transistor and the second transistor, cutting off the third transistor, enabling the data line to output a data voltage higher than the reference voltage, such that a voltage across the driving capacitor is a sum of the threshold voltage and another voltage, the another voltage being related to a voltage difference between the data voltage and the reference voltage; and cutting off the first transistor and the third transistor, conducting the second transistor, such that the driving transistor is driven by the driving capacitor to be conducted so as to drive the light-emitting element by a first voltage provided by the first power line to emit light.

BRIEF DESCRIPTION OF THE DRAWINGS

The following drawings are intended to illustrate embodiments of the present disclosure in detail with reference to specific embodiments. It should be understood that, elements illustrated in drawings are not representative of actual size and ratio relationships and are merely illustrative, and should not to be construed as a limitation of the present disclosure.

DETAILED DESCRIPTION

In order to make purposes, technical solutions and advantages of embodiments of the present disclosure more clear, reference will be made in detail to embodiments of the present disclosure with accompanying drawings. It should be understood that, the embodiments described herein according to drawings are explanatory and illustrative, and are not construed to limit the present disclosure.

Figure 1:
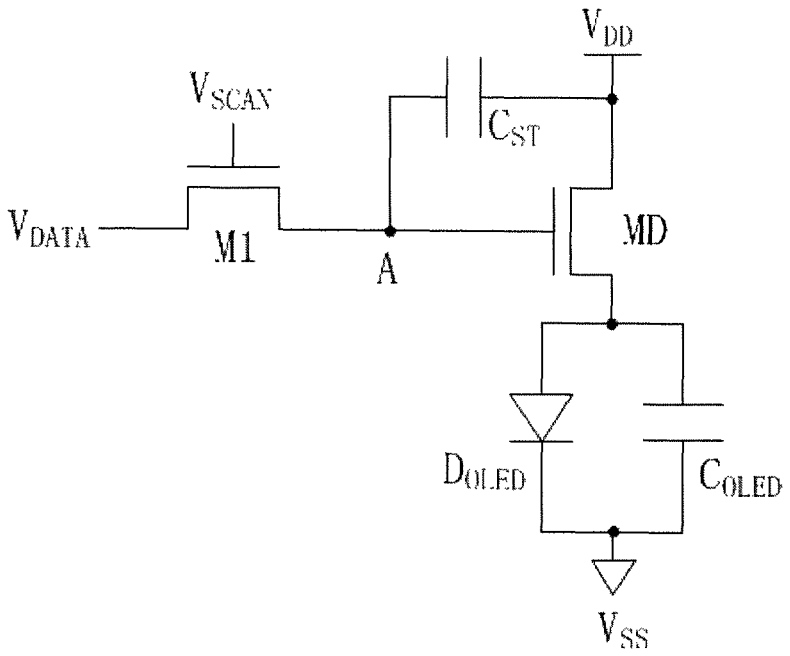
FIG. 1 is schematic diagram of a pixel circuit in the related art.
Figure 2:
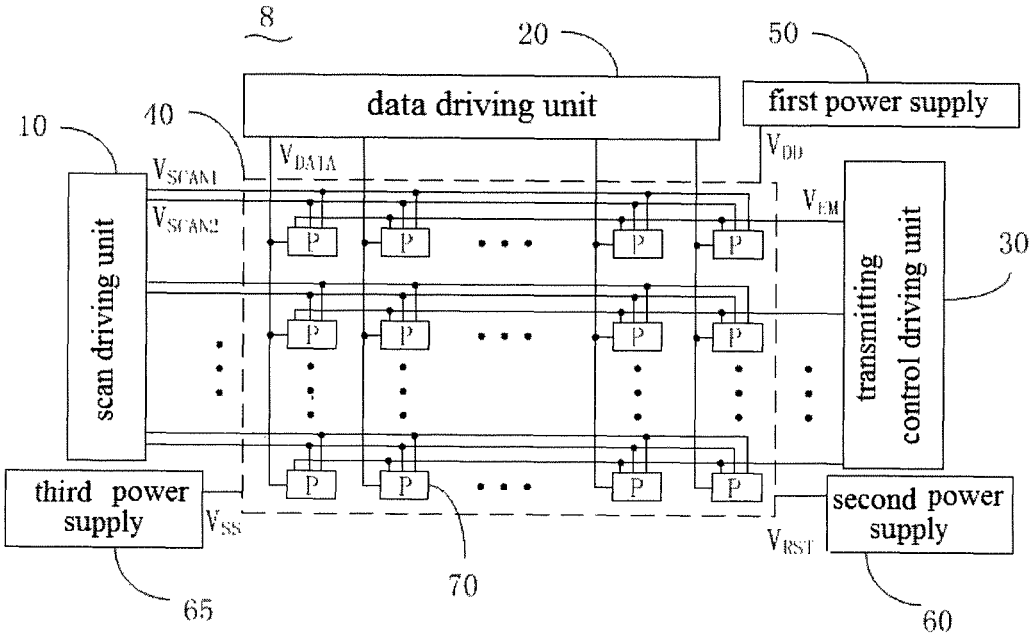
FIG. 2 is a schematic diagram of a display panel according to an embodiment of the present disclosure.

Referring to FIG. 2, a display panel 8 includes a scan driving unit 10, a data driving unit 20, an emitting control driving unit 30, a display unit 40, a first power supply 50, a second power supply 60 and a third power supply 65. The display unit 40 includes a plurality of pixel circuits 70 arranged in a matrix. The scan driving unit 10, the data driving unit 20 and the emitting control driving unit 30 are configured to provide a scanning signal $V_{SCAN}$ (including a first scanning signal $V_{SCAN1}$ and a second scanning signal $V_{SCAN2}$), a data signal $V_{DATA}$ and a transmitting control signal $V_{EM}$ to each pixel circuit 70, respectively. The first power supply 50, the second power supply 60 and the third power supply 65 are configured to provide a first voltage $V_{DD}$, a second voltage $V_{RST}$ and the third voltage $V_{SS}$ to each pixel circuit 70, respectively.

Figure 3:
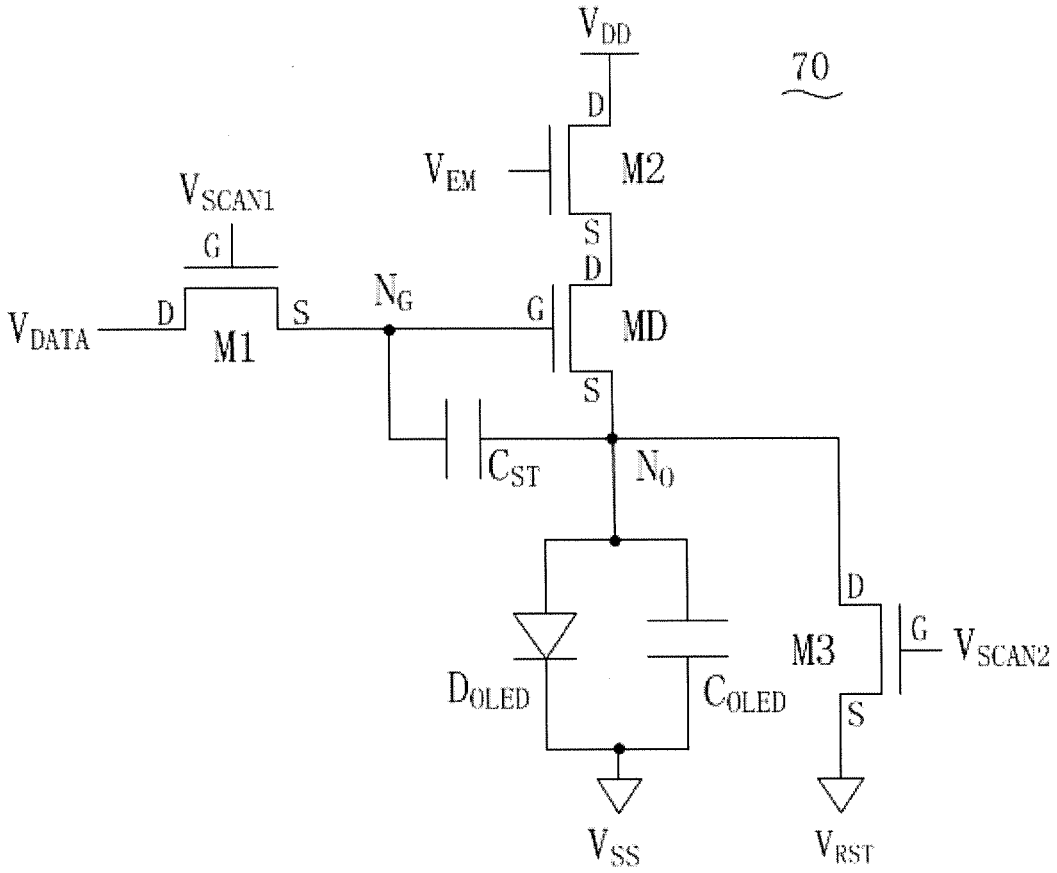
FIG. 3 is a schematic diagram of a pixel circuit of a display panel in FIG. 2 according to an embodiment of the present disclosure.

Referring to FIG. 3, in an embodiment of the present disclosure, the pixel 70 has a first scanning line configured to transmit a first scanning signal $V_{SCAN1}$, a second scanning line configured to transmit a second scanning signal $V_{SCAN2}$, a first power line configured to transmit a first power supply 50, a second power line configured to transmit a second power supply 60, a third power line configured to transmit a third power supply 65, a data line configured to transmit a data signal $V_{DATA}$, and a control line configured to transmit a transmitting control scanning signal $V_{EM}$.

The pixel circuit 70 further includes: a driving transistor MD; a first transistor M1, a control electrode of the first transistor M1 being connected to a first scanning line, and two controlled electrodes of the first transistor M1 being connected to a data line and a control electrode of the driving transistor MD respectively; a second transistor M2, a control electrode of the second transistor M2 being connected to a control line, and two controlled electrodes of the second transistor M2 being connected to a first power line and a first controlled electrode of the driving transistor MD respectively; a third transistor M3, a control electrode of the third transistor M3 being connected to a second scanning line, and two controlled electrodes of the third transistor M3 being connected to a second power line and a second controlled electrode of the driving transistor MD respectively; a driving capacitor $C_{ST}$, two terminals of the driving capacitor $C_{ST}$ being connected to the control electrode and the second controlled electrode of the driving transistor MD respectively; and a light-emitting element, including a light-emitting diode $D_{OLED}$ and an inductance capacitor $C_{OLED}$ of the light-emitting diode connected in parallel between a third power line and the second controlled electrode of the driving transistor MD.

In detail, in following embodiments, an organic light-emitting diode (OLED for short) is an example of the light-emitting element. However, it should be understood that, the present disclosure is not limited to such example, the light-emitting element may also be an inorganic light-emitting diode. In following embodiments, the driving transistor MD, the first transistor M1, the second transistor M2 and the third transistor M3 are preferably thin-film field-effect transistors, and are specifically N-type thin-film field-effect transistors, but are not limited thereto, which may also be P-type thin-film field-effect transistors or other electronic devices capable of realizing switching functions, such as a triode. Those skilled in the art may know how transistors of other types operate according to descriptions of following embodiments, which will not be described in the present disclosure. In this case, a voltage value of the second voltage $V_{RST}$ is lower than a voltage value of the first voltage $V_{DD}$, and the third voltage $V_{SS}$ may be a ground voltage.

The driving transistor MD includes a control electrode and two controlled electrodes controlled to be conducted or non-conducted by the control electrode, in which, the control electrode is a gate G of the driving transistor MD, and the two controlled electrodes are a drain D and a source S. Similarly, the first transistor M1, the second transistor M2 and the third transistor M3 are in the same way as the driving transistor MD. A drain D and a source S of the first transistor M1 are connected to the data line and the gate G of the driving transistor MD respectively, and a gate G of the first transistor M1 is connected to the first scanning line. A drain D and a source S of the second transistor M2 are connected to the first power line and the drain D of the driving transistor MD respectively, and a gate G of the second transistor M2 is connected to the control line. A drain D and a source S of the third transistor M3 are connected to the source S of the driving transistor MD and the second power line respectively, and a gate G of the third transistor M3 is connected to the second scanning line. Two terminals of the driving capacitor $C_{ST}$ are connected to the gate G and the source S of the driving transistor MD respectively. The light-emitting diode $D_{OLED}$ of the light-emitting element and the inductance capacitor $C_{OLED}$ of the light-emitting diode $D_{OLED}$ are connected in parallel between the source S of the driving transistor MD and the third power line, and a cathode of the light-emitting diode $D_{OLED}$ is connected to the third power line. In this embodiment, a node that connecting the first transistor M1, the driving capacitor $C_{ST}$ and the driving transistor MD is defined as $N_G$, and a node that connecting the driving capacitor $C_{ST}$, the driving transistor MD, the light-emitting element and the third transistor M3 is defined as $N_o$.

Figure 4A:
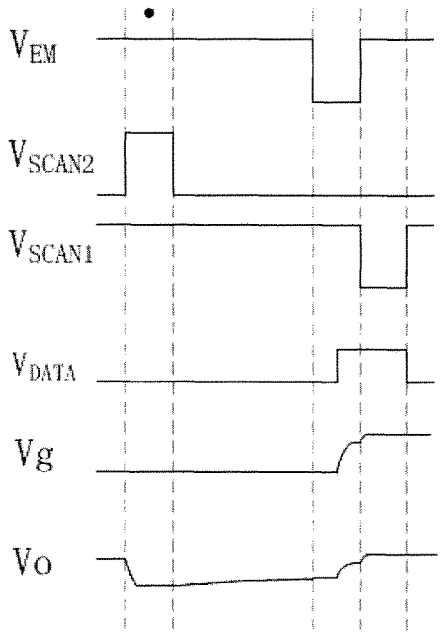
FIG. 4*a* is a timing diagram according to an embodiment of the present disclosure and FIG. 4*b* is a schematic diagram of a pixel circuit in FIG. 3 at a first phase of the timing diagram.
Figure 4B:
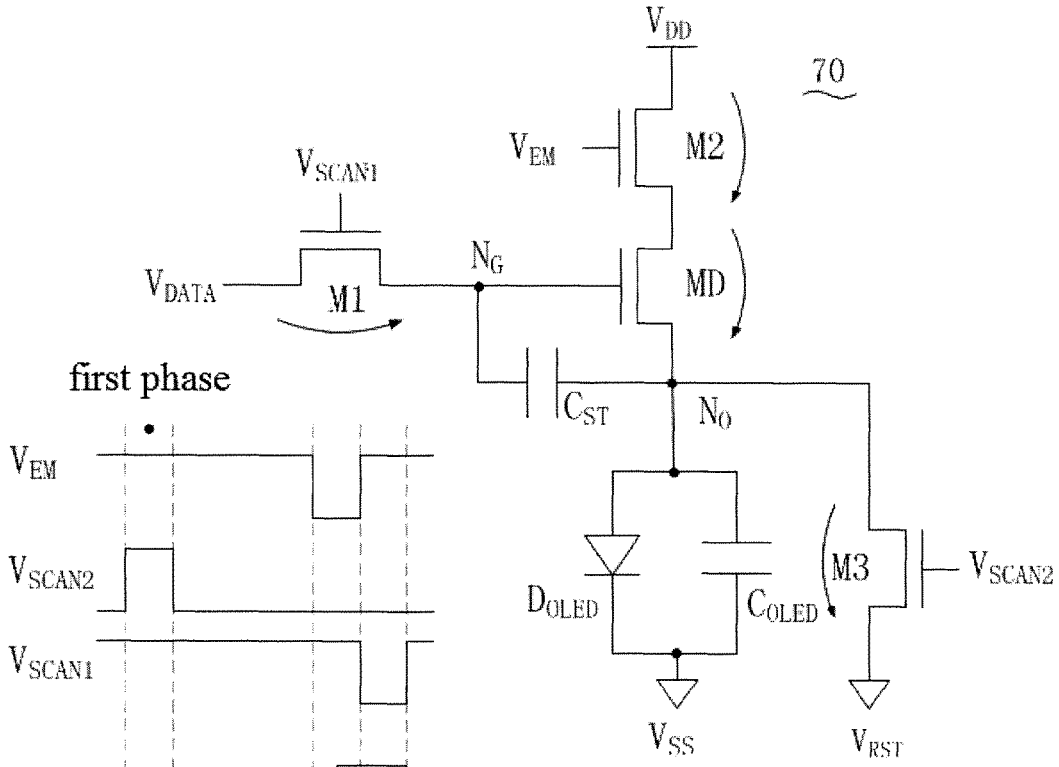

Referring to FIG. 4*a* and FIG. 4*b*, the pixel circuit 70 in FIG. 3 is configured to be operating according to a timing diagram of an embodiment illustrated in FIG. 4*a*. In the timing diagram illustrated in FIG. 4*a*, each operating cycle of the pixel circuit 70 can be divided into four phases. At a first phase, an operating condition of the pixel circuit 70 is illustrated in FIG. 4*b*. At the first phase, the driving capacitor $C_{ST}$ and the inductance capacitor $C_{OLED}$ are reset. In detail, the transmitting control signal $V_{EM}$, the first scanning signal $V_{SCAN1}$ and the second scanning signal $V_{SCAN2}$ are high-level signals. In this case, the first transistor M1, the second transistor M2 and the third transistor M3 are conducted, both terminals of the driving capacitor $C_{ST}$, that is, the node $N_G$ and the node $N_O$ are charged to a reference voltage $V_{REF}$ written by the data line and the second voltage $V_{RST}$ via the first transistor M1 and the third transistor M3 respectively, and a voltage difference between the reference voltage $V_{REF}$ and the second voltage $V_{RST}$ is higher than a threshold voltage $V_{TH}$ of the driving transistor MD, i.e., $V_{REF}-V_{RST}>V_{TH}$, and at the same time, a voltage difference between the second voltage $V_{RST}$ and the third voltage $V_{SS}$ is lower than a threshold voltage of the light-emitting diode $D_{OLED}$. In this case, the driving transistor MD is conducted and the light-emitting element does not emit light, the driving capacitor $C_{ST}$ is reset to be a preset voltage $V_{REF}-V_{REF2}$, and the inductance capacitor $C_{OLED}$ is reset to a preset second voltage $V_{REF2}-Vss$. $V_{REF2}$ is a voltage of the node $N_O$ at this phase. Since a bias voltage setting of the $V_{SCAN2}$, a driving voltage of the M3 is large, a drain-source voltage is small, and the voltage $V_{REF2}$ of the node $N_O$ is close to $V_{RST}$.

In this embodiment, it is suitable for transistors with different threshold voltages that the second voltage $V_{RST}$ and the third voltage $V_{SS}$ are set to be different, thereby improving a flexibility of pre-charging each capacitor/each node at the first phase. However, it should be understood that, potentials of the second voltage $V_{RST}$ and the third voltage $V_{SS}$ may be the same as long as the voltage difference satisfies the above condition. That is, the third power supply 65 may be omitted, the light-emitting diode $D_{OLED}$ and the inductance capacitor $C_{OLED}$ can thus connected to the second power line directly, and in this case, the ground voltage may be output by the second power supply 60. Therefore, in descriptions and claims of the present disclosure, the voltage provided by the third power supply 65 may be consistent with the voltage provided by the second power supply 60. Furthermore, in other words, the third power supply 65 and the second power supply 60 may be a same power supply, that is, the second power line and the third power line may be a same power line, and a separate description thereof should not be construed as separate two power supplies to limit protection ranges of the present disclosure.

Figures 5A, 5B:
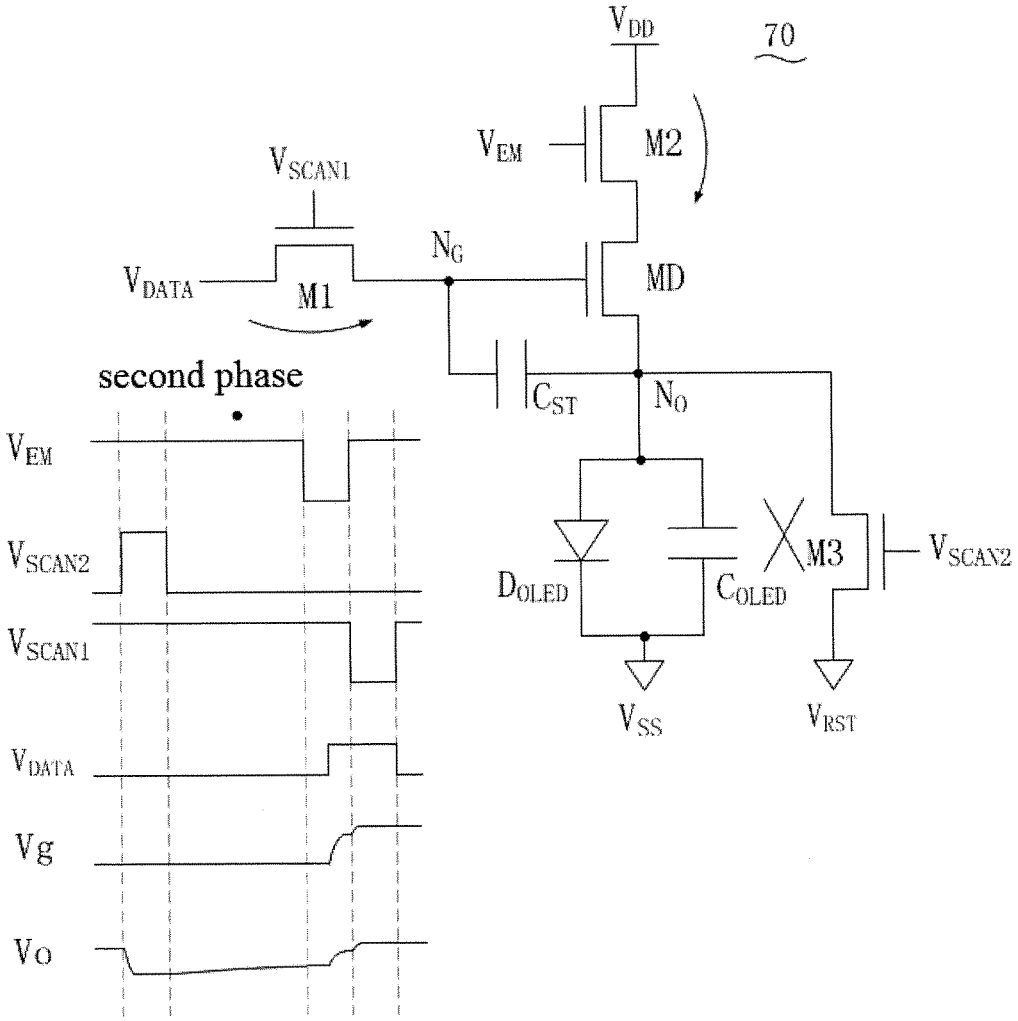
FIG. 5*a* is a timing diagram and FIG. 5*b* is a schematic diagram of a pixel circuit in FIG. 3 at a second phase of the timing diagram.

Referring to FIG. 5*a* and FIG. 5*b*, at the second phase, an operating condition of the pixel circuit 70 is illustrated in FIG. 5*b*. At the second phase, the node $N_O$, i.e., a terminal that connecting the driving capacitor $C_{ST}$ and the source S of the driving transistor MD is charged to a voltage difference between the reference voltage $V_{REF}$ and the threshold voltage $V_{TH}$ of the driving transistor MD. In detail, the transmitting control signal $V_{EM}$, the first scanning signal $V_{SCAN1}$ and the second scanning signal $V_{SCAN2}$ are a high-level signal, a high-level signal and a low-level signal respectively. In this case, the first transistor M1 is conducted, the second transistor M2 is conducted and the third transistor M3 is cut off. In this case, the driving transistor MD is still conducted, the data line still is written with the reference voltage $V_{REF}$, and a voltage Vg of the node $N_G$ thus remains at the reference voltage $V_{REF}$. Since the driving transistor MD is conducted, the driving capacitor $C_{ST}$ is gradually charged by the first voltage $V_{DD}$ via the driving transistor MD, until the voltage Vo of the node $N_O$ is charged to be a voltage difference $V_{REF}-V_{TH}$ between the reference voltage $V_{REF}$ and the threshold voltage $V_{TH}$ of the driving transistor MD. In this case, a voltage difference $V_{GS}$ between the gate G and the source S of the driving transistor MD is $V_{TH}$. When the voltage Vo of the node $N_O$ is further increased, the driving transistor MD may be cut off, thus the voltage $V_O$ of the node $N_O$ remains at $V_{REF}-V_{TH}$. At this phase, the driving transistor MD is conducted first and cut off in a very final end, and the light-emitting element does not emit light.

Another embodiment of the present disclosure is provided herein, which is different from a case that the third transistor M3 is connected in a diode method, i.e., the drain and the gate of the third transistor is connected together, and the driving transistor MD may be compensated only when $V_{TH}$ is positive. In this embodiment, the node $N_G$ and the node $N_O$ can be charged with different potentials, and the drain and the gate need not be connected together, and thus even if the threshold is negative, the driving transistor can still be compensated. Therefore, in a compensation process of second phase described above, there is no additional requirement for the value of the threshold voltage $V_{TH}$ of the driving transistor MD, $V_{TH}$ may be positive or negative.

Figure 6A:
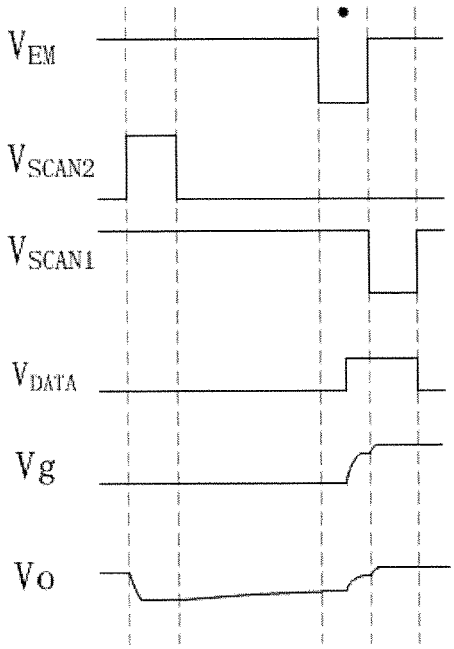
FIG. 6*a* is a timing diagram and FIG. 6*b* is a schematic diagram of a pixel circuit in FIG. 3 at a third phase of the timing diagram.
Figure 6B:
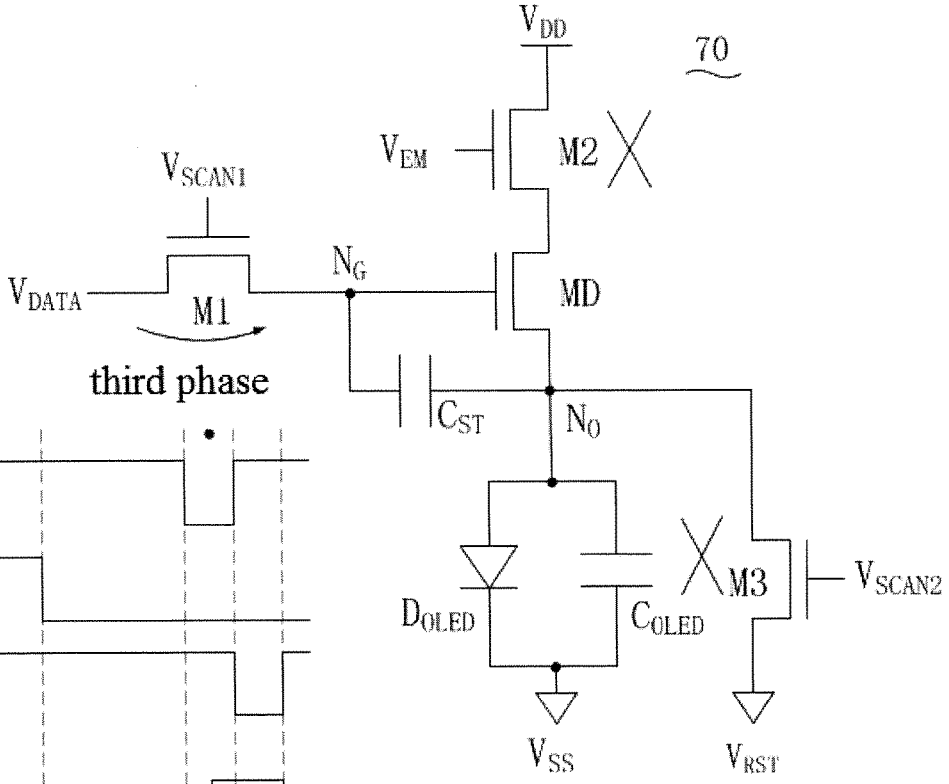

Referring to FIG. 6*a* and FIG. 6*b*, at a third phase, an operating condition of the pixel circuit 70 is illustrated in FIG. 6*b*. At the third phase, the second transistor M2 is cut off, thus a connection between the first power supply $V_{DD}$ and the driving transistor MD is cut off, and a data voltage is input to the gate of the driving transistor MD. In detail, the transmitting control signal $V_{EM}$, the first scanning signal $V_{SCAN1}$ and the second scanning signal $V_{SCAN2}$ are a low-level signal, a high-level signal and a low-level signal respectively. In this case, the first transistor M1 is conducted, the second transistor M2 and the third transistor M3 are cut off, thus, there is no current flowing through the driving transistor MD. In this case, the data line outputs the data voltage $V_{DATA}$ higher than the reference voltage $V_{REF}$, and the voltage of the node $N_G$ is thus increased to $V_{DATE}$. A voltage change of the node $N_G$ is shared by the driving capacitor $C_{ST}$ and the inductance capacitor $C_{OLED}$. In this case, the voltage change value ΔV at the node $N_O$ is:

$$(V_{DATA}-V_{REF})*[1/C_{OLED1}/(1/C_{ST1}+1/C_{OLED1})]-(V_{DATA}-V_{REF})*C_{ST1}/(C_{OLED1}+C_{ST1}).$$

$C_{ST1}$ and $C_{OLED1}$ are capacitance values of the driving capacitor $C_{ST}$ and the inductance capacitor $C_{OLED}$ respectively. In this case, the voltage of the node $N_O$ is $(V_{REF}-V_{TH})+\Delta V$. A voltage $V_{ST}$ across the driving capacitor $C_{ST}$ is:

$$V_{DATA}-[(V_{REF}-V_{TH})+\Delta V]=$$
$$V_{DATA}-[(V_{REF}-V_{TH})+(V_{DATA}-V_{REF})*C_{ST1}/(C_{OLED1}+C_{ST1})]=$$
$$V_{TH}+(V_{DATA}-V_{REF})*C_{OLED1}/(C_{OLED1}+C_{ST1}).$$

Figures 7A, 7B:
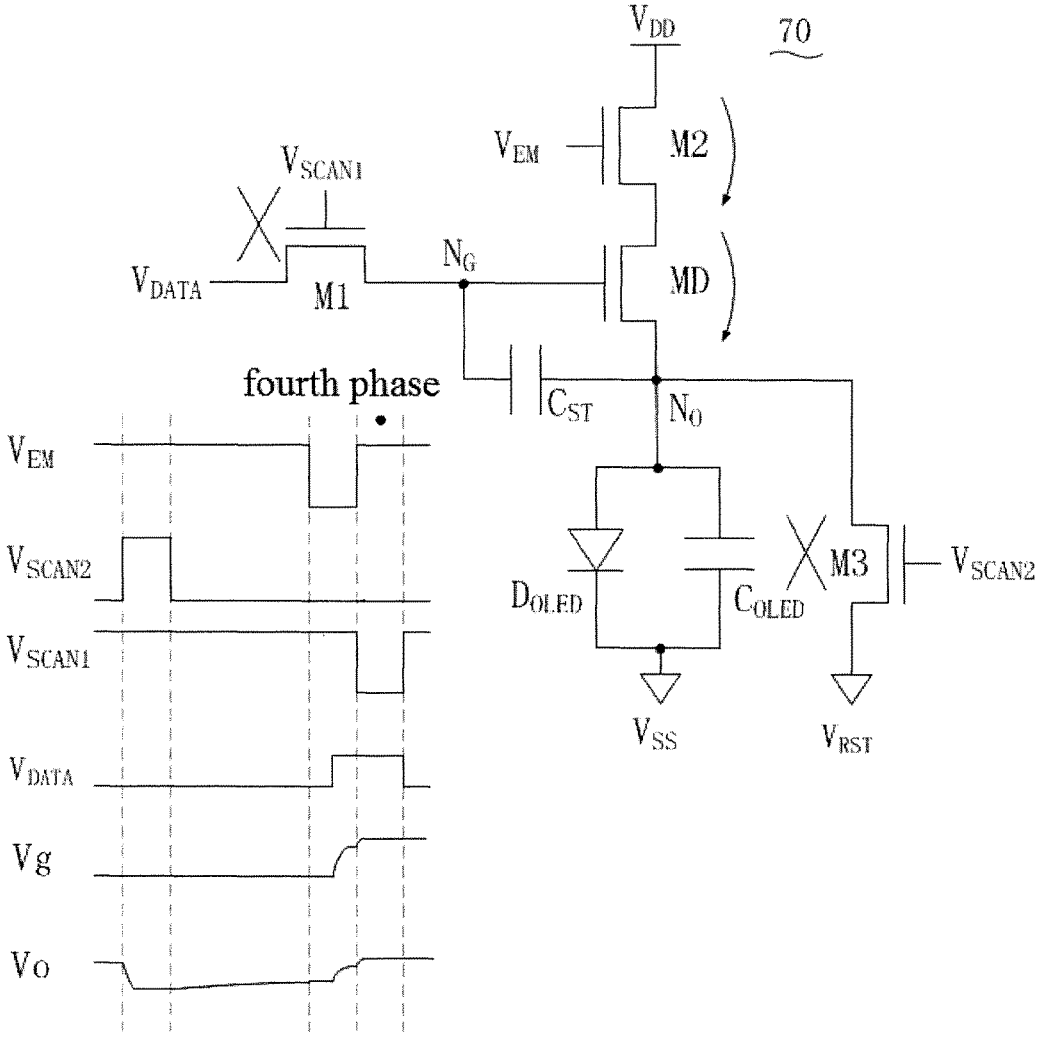
FIG. 7*a* is a timing diagram and FIG. 7*b* is a schematic diagram of a pixel circuit in FIG. 3 at a fourth phase of the timing diagram.

Referring to FIG. 7*a* and FIG. 7*b*, at a fourth phase, an operating condition of the pixel circuit 70 is illustrated in FIG. 7*b*. At the fourth phase, the transmitting control signal $V_{EM}$, the first scanning signal $V_{SCAN1}$ and the second scanning signal $V_{SCAN2}$ are a high-level signal, a low-level signal and a low-level signal respectively. In this case, the first transistor M1 and the third transistor M3 are cut off, and the second transistor M2 is conducted, and with an effect of power stored in the driving capacitor $C_{ST}$, the $V_{GS}$ is higher than $V_{TH}$ and the driving transistor MD is thus conducted. In this case, current generated by the first power supply $V_{DD}$ flows through the light-emitting diode $D_{OLED}$ to enable the light-emitting diode $D_{OLED}$ to emit light and also flows through the inductance capacitor $C_{OLED}$. At a beginning phase of the fourth phase, the potential of Vo is low, and the light-emitting diode $D_{OLED}$ is cut off, therefore, most of the current flows through $C_{OLED}$, and the $C_{OLED}$ is charged, so that the potential of $N_O$ is increased. The voltage difference $V_{GS}$ between the gate and the source of the driving transistor MD is determined by the voltage across the $C_{ST}$. Since the first transistor M1 is cut off at this phase, no current flows through M1, the voltage across the $C_{ST}$ remains constant, and the potential of $V_G$ of the node $N_G$ is increased with the increase of the Vo. Finally, the Vo is increased to a certain potential and then remains constant, and all of the current flowing from the power supply $V_{DD}$ flows through the light-emitting diode $D_{OLED}$. It can be seen from formula 1 in background, in this case, the current flowing through the light-emitting element may be:

$$I_{OLED}=$$
$$1/2*\beta(V_{TH}+(V_{DATA}-V_{REF})*C_{OLED1}/(C_{OLED1}+C_{ST1})-V_{TH})^2=$$
$$1/2*\beta((V_{DATA}-V_{REF})*C_{OLED1}/(C_{OLED1}+C_{ST1}))^2$$

Figure 8:
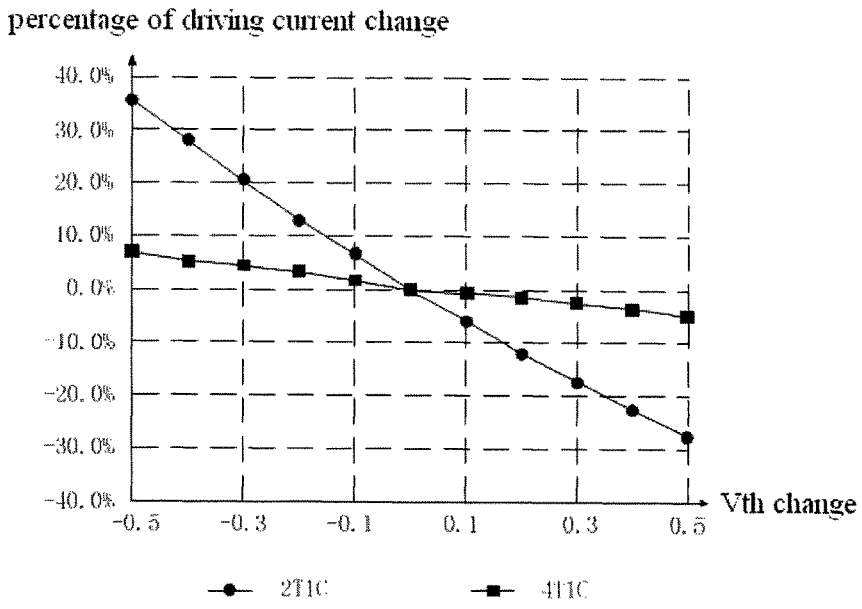
FIG. 8 is a schematic diagram illustrating a relationship between a threshold voltage of a driving transistor of a pixel circuit in FIG. 3 and a change of a current flowing through a light-emitting diode.

It can be seen from above formula, in the fourth phase, the current flowing through the light-emitting element is related only to voltages $V_{REF}$ and $V_{DATA}$ provided by the data line at different phases, the capacitance value $C_{ST1}$ of the driving capacitor $C_{ST}$ and the capacitance value $C_{OLED1}$ of the inductance capacitor $C_{OLED}$, thereby reducing an influence of the change of the threshold voltage on the light-emitting element. As illustrated in FIG. 8, compared with the 2T1C structure in the related art, a current change of a 4T1C structure of the present disclosure is reduced significantly under a same change of the threshold voltage $V_{TH}$, thereby improving uniformity of brightness of the display panel 8.

Figure 9:
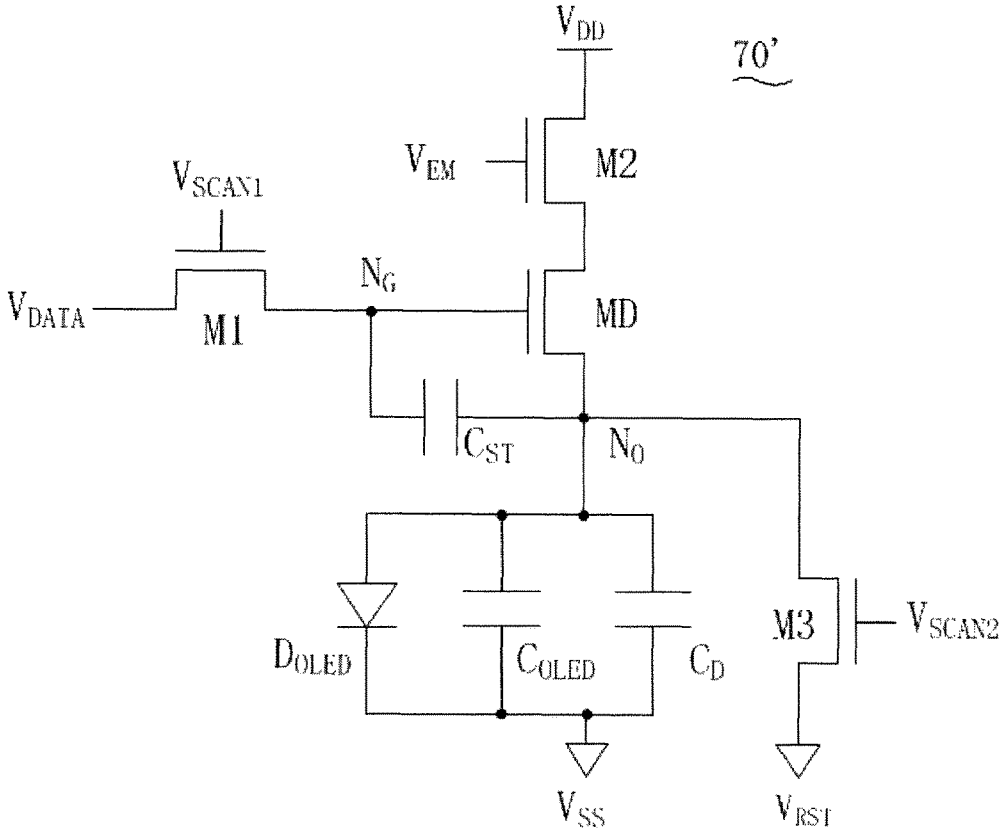
FIG. 9 is a schematic diagram of a pixel circuit of a display panel in FIG. 2 according to another embodiment of the present disclosure.

Referring to FIG. 9, FIG. 9 is a schematic diagram of another pixel circuit 70' of a display panel in FIG. 2 according to an embodiment of the present disclosure. The difference between the pixel circuit 70' and the pixel circuit 70 of the above embodiment lies in that the pixel circuit 70' further includes an additional capacitance $C_D$ in parallel to the light emitting-element. The additional capacitance $C_D$ is configured to increase a parallel capacitance value obtained by subjecting the additional capacitance $C_D$ being connected in parallel to the inductance capacitor $C_{OLED}$ when the capacitance value $C_{OLED1}$ of the inductance capacitor $C_{OLED}$ is small, such that the parallel capacitance value is far higher the capacitance value $C_{ST1}$ of the driving capacitor $C_{ST}$, so that a voltage change of the node $N_O$ can be calculated in the same way as calculating the voltage change of the node $N_O$ described in the above embodiment. In this case, the voltage change of the node $N_O$ is:

$$(V_{DATA}-V_{REF})*[1/C_{OLED1}'/(1/C_{ST1}+1/C_{OLED}')]$$

$C_{OLED1}'$ is the parallel capacitance value of the inductance capacitor $C_{OLED}$ and the additional capacitance $C_D$ connected in parallel. A calculation principle and operating principle of the $C_{OLED1}$ are similar to those described above, which is not described in detail here.

Figures 10A, 10B:
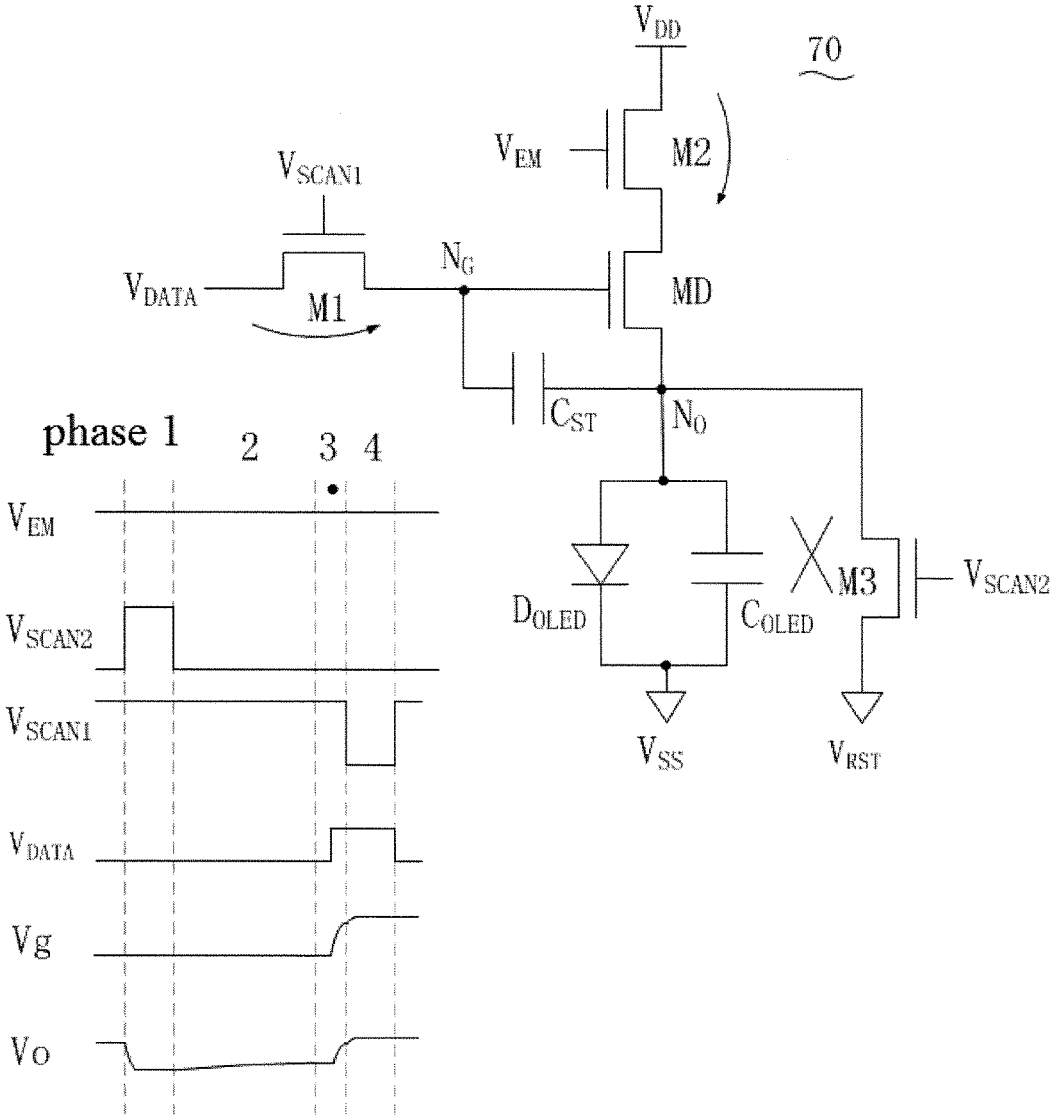
FIG. 10*a* is a timing diagram of the pixel circuit in FIG. 3 according to another embodiment of the present disclosure and FIG. 10*b* is a schematic diagram of the pixel circuit in FIG. 3 at a third phase of the timing diagram.
Figure 11:
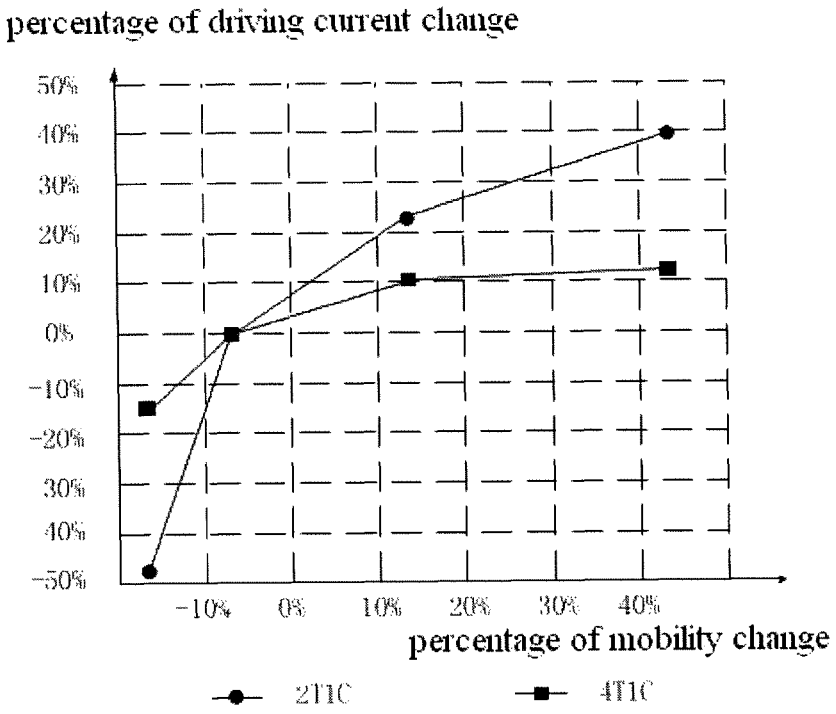
FIG. 11 is a schematic diagram illustrating a relationship between a carrier mobility of a driving transistor of a pixel circuit and a current change of a light-emitting diode at the timing diagram of FIG. 10*b*.

Referring to FIG. 10*a*, FIG. 10*a* is another timing diagram of the pixel circuit in FIG. 3 according to an embodiment of the present disclosure. The difference between the present embodiment and the embodiment described above lies in that the transmitting control signal $V_{EM}$ remains at a high level at the first to the fourth phases, thereby allowing the pixel circuit 70 to perform a mobility compensation. In detail, in the timing diagram of the present embodiment, operations at the first and the second phase are the same as those of the above embodiment, which is not described here. At the third phase, an operation of the pixel circuit 70 is illustrated in FIG. 10*b*, the first transistor M1 and the second transistor M2 are conducted, and the third transistor is cut off. The node $N_O$ is charged by the first power supply $V_{DD}$ via the driving transistor MD, and a charging efficiency is determined by a mobility of the driving transistor MD. When the mobility of the driving transistor MD is high, the charging efficiency is high, the node $N_O$ is charged to a higher voltage, and thus the voltage across the driving capacitor $C_{ST}$ becomes small. When the mobility of the driving transistor MD is low, the node $N_O$ is charged to a lower voltage, thereby achieving the mobility compensation. Certainly, a length of the third phase also determines a degree of the compensation. An effect of the above dynamic compensation effect can be seen in FIG. 11, compared with the 2T1C structure in the related art, the 4T1C structure can perform better compensation for a change of the mobility. It should be understood that, the pixel circuit 70' described above is also applicable to a driving mode in this timing diagram.

In descriptions of the present disclosure, terms such as "first" and "second" are used herein for purposes of description and are not intended to indicate or imply relative importance or significance. Thus, the feature defined with "first" and "second" may comprise one or more this feature. In the description of the present disclosure, "a plurality of" means two or more than two, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

The above descriptions are only preferred embodiment of the present disclosure, and cannot be construed to limit the present disclosure, and changes, alternatives, and modifications can be made in the embodiments without departing from spirit, principles and scope of the present disclosure.

What is claimed is:

1. A method for driving a pixel circuit, wherein the pixel circuit comprises:

a driving transistor having a threshold voltage;

a first transistor, a control electrode of the first transistor being connected to a first scanning line, and two controlled electrodes of the first transistor being connected to a data line and a control electrode of the driving transistor, respectively;

a second transistor, a control electrode of the second transistor being connected to a control line, and two controlled electrodes of the second transistor being connected to a first power line and a first controlled electrode of the driving transistor, respectively;

a third transistor, a control electrode of the third transistor being connected to a second scanning line, and two controlled electrodes of the third transistor being directly connected to a second power line and a second controlled electrode of the driving transistor, respectively;

a driving capacitor, two terminals of the driving capacitor being connected to the control electrode and the second controlled electrode of the driving transistor, respectively; and a light-emitting element, comprising a light-emitting diode and an inductance capacitor of the light-emitting diode connected in parallel between a third power line and the second controlled electrode of the driving transistor;

the method comprising:

conducting the first transistor, the second transistor and the third transistor, and charges stored in the driving capacitor being released to the data line and the second power line via the first transistor and the third transistor, respectively;

conducting the first transistor and the second transistor, cutting off the third transistor, outputting by the data line a reference voltage to the driving transistor via the first transistor, a first voltage provided by the first power line being applied for charging the driving capacitor via the second transistor and the driving transistor until a voltage across a control electrode and a controlled electrode of the driving transistor being the threshold voltage;

conducting the first transistor, cutting off the second transistor and the third transistor, outputting by the data line a data voltage higher than the reference voltage, and a voltage across the driving capacitor being charged to a sum of the threshold voltage and another voltage, the another voltage being related to a voltage difference between the data voltage and the reference voltage; and cutting off the first transistor and the third transistor, conducting the second transistor, driving by the driving capacitor the driving transistor to be conducted, such that the first voltage drives the light-emitting element to emit light.

2. The method according to claim 1, wherein, charges stored in the driving capacitor being released to the data line and the second power line via the first transistor and the third transistor, respectively further comprises:

enabling the data line to provide the reference voltage, enabling the second power line to provide a second voltage, and a voltage difference between the reference voltage and the second voltage being higher than the threshold voltage.

3. The method according to claim 2, wherein, charges stored in the driving capacitor being released to the data line and the second power line via the first transistor and the third transistor, respectively further comprises:

enabling a voltage difference between the second voltage and a third voltage provided by the third power line to be lower than a threshold voltage of the light-emitting element.

4. The method according to claim 1, wherein the driving transistor, the first transistor, the second transistor, and the third transistor are thin-film field-effect transistors.

5. The method according to claim 1, wherein a first voltage provided by the first power line is higher than a second voltage provided by the second power line.

6. The method according to claim 5, wherein a voltage difference between the first voltage and the second voltage is higher than a threshold voltage of the driving transistor, and a voltage difference between the second voltage and a third voltage provided by the third power line is lower than a threshold voltage of the light-emitting diode.

7. The method according to claim 6, wherein the third voltage is a ground voltage.

8. The method according to claim 1, wherein the pixel circuit further comprises an additional capacitor connected in parallel to the light-emitting element.

9. A method for driving a pixel circuit wherein the pixel circuit comprises:

a driving transistor having a threshold voltage;

a first transistor, a control electrode of the first transistor being connected to a first scanning line, and two controlled electrodes of the first transistor being connected to a data line and a control electrode of the driving transistor, respectively;

a second transistor, a control electrode of the second transistor being connected to a control line, and two controlled electrodes of the second transistor being connected to a first power line and a first controlled electrode of the driving transistor, respectively;

a third transistor, a control electrode of the third transistor being connected to a second scanning line, and two controlled electrodes of the third transistor being directly connected to a second power line and a second controlled electrode of the driving transistor, respectively;

a driving capacitor, two terminals of the driving capacitor being connected to the control electrode and the second controlled electrode of the driving transistor, respectively; and a light-emitting element, comprising a light-emitting diode and an inductance capacitor of the light-emitting diode connected in parallel between a third power line and the second controlled electrode of the driving transistor;

the method comprising:

conducting the first transistor, the second transistor and the third transistor, such that the driving transistor is conducted and a voltage across the driving capacitor and a voltage across the light-emitting element is reset;

conducting the first transistor and the second transistor, cutting off the third transistor, enabling the data line to output a reference voltage, such that a voltage of a first node connecting the driving capacitor, the driving transistor and the light emitting element with each other is a voltage difference between the reference voltage and the threshold voltage;

conducting the first transistor and the second transistor, cutting off the third transistor, enabling the data line to output a data voltage higher than the reference voltage, such that a voltage across the driving capacitor is a sum of the threshold voltage and another voltage, the another voltage being related to a voltage difference between the data voltage and the reference voltage; and cutting off the first transistor and the third transistor, conducting the second transistor, such that the driving transistor is driven by the driving capacitor to be conducted so as to drive the light-emitting element by a first voltage provided by the first power line to emit light.

10. The method according to claim 9, wherein enabling the data line to provide the reference voltage, enabling the second power line to provide a second voltage, a voltage difference between the reference voltage and the second voltage being higher than the threshold voltage, and a voltage difference between the second voltage and a third voltage provided by the third power line being lower than a threshold voltage of the light-emitting element.

11. The method according to claim 9, wherein the driving transistor, the first transistor, the second transistor, and the third transistor are thin-film field-effect transistors.

12. The method according to claim 9, wherein a first voltage provided by the first power line is higher than a second voltage provided by the second power line.

13. The method according to claim 12, wherein a voltage difference between the first voltage and the second voltage is higher than a threshold voltage of the driving transistor, and a voltage difference between the second voltage and a third voltage provided by the third power line is lower than a threshold voltage of the light-emitting diode.

14. The method according to claim 13, wherein the third voltage is a ground voltage.

15. The method according to claim 9, wherein the pixel circuit further comprises an additional capacitor connected in parallel to the light-emitting element.

* * * * *